US007357271B2

(12) United States Patent
Hase et al.

(10) Patent No.: US 7,357,271 B2
(45) Date of Patent: Apr. 15, 2008

(54) INSULATED CONTAINER WITH ACCESS DOOR

(75) Inventors: Gary M. Hase, Monee, IL (US); David A. Arnold, Schererville, IN (US); Allen Polowinczak, Monee, IL (US)

(73) Assignee: Tegrant Diversified Brands, Inc., DeKalb, IL (US)

( * ) Notice: Subject to any disclaimer, the term of this patent is extended or adjusted under 35 U.S.C. 154(b) by 414 days.

(21) Appl. No.: 10/778,210

(22) Filed: Feb. 17, 2004

(65) Prior Publication Data

US 2005/0178770 A1 Aug. 18, 2005

(51) Int. Cl.

| | |
|---|---|
| ***F25D 23/00*** | (2006.01) |
| ***F25D 3/08*** | (2006.01) |
| ***B65D 45/16*** | (2006.01) |
| ***B65D 21/00*** | (2006.01) |
| ***B65D 51/04*** | (2006.01) |

(52) U.S. Cl. ..... 220/592.2; 220/810; 220/324; 220/659; 206/511; 62/457.7

(58) Field of Classification Search ..... 220/6, 220/7, 831, 326, 592.2, 810, 820, 821, 826, 220/802, 592.25, 592.26; 206/600, 386, 206/511, 512; 62/440, 457.7, 371
See application file for complete search history.

(56) References Cited

U.S. PATENT DOCUMENTS

| | | | | |
|---|---|---|---|---|
| 3,427,822 A | | 2/1969 | Conly | |
| 3,503,535 A | * | 3/1970 | Sparks, Sr. | 220/326 |
| 3,585,813 A | | 6/1971 | Hansen | |
| 4,643,327 A | * | 2/1987 | Campbell | 220/215 |
| 4,887,731 A | | 12/1989 | Pett et al. | |
| 4,917,255 A | * | 4/1990 | Foy et al. | 220/6 |
| 4,923,079 A | * | 5/1990 | Foy | 220/7 |
| 5,056,667 A | * | 10/1991 | Coogan | 206/600 |
| 5,199,570 A | | 4/1993 | McKenzie | |
| 5,310,073 A | * | 5/1994 | Johannsson | 220/254.3 |
| 5,592,828 A | | 1/1997 | Tollet et al. | |
| 5,601,202 A | * | 2/1997 | Meacham et al. | 220/6 |
| 5,725,118 A | | 3/1998 | Slager et al. | |

(Continued)

FOREIGN PATENT DOCUMENTS

EP 0 503 253 A1 9/1992

OTHER PUBLICATIONS

"Capacities and Freeze-Retention Times"; Bonar Plastics; Polar Insulated Containers; Ontario, Canada, May 2001.

(Continued)

*Primary Examiner*—Robin A. Hylton
(74) *Attorney, Agent, or Firm*—Buchanan Ingersoll & Rooney PC

(57) ABSTRACT

An insulated container includes a bottom and four walls connected to the bottom; a top which fits on the four walls; a portion of the top is pivotally mounted so as to be opened to provide access to the insulated container through a first opening; a portion of one of the four walls is pivotally mounted so as to be opened to provide access to the insulated container through a second opening; wherein the first and second openings are contiguous to provide a combined access area to the container that extends across both the top and the one of the four walls.

32 Claims, 6 Drawing Sheets

U.S. PATENT DOCUMENTS

| | | | | |
|---|---|---|---|---|
| 6,386,383 | B1 | 5/2002 | Roudonis | |
| 6,533,122 | B1 | 3/2003 | Plunkett | |
| 6,581,769 | B2 | 6/2003 | Nist | |
| 6,776,300 | B2 * | 8/2004 | Walsh et al. | 220/6 |
| 6,918,508 | B2 * | 7/2005 | Hwang | 220/826 |

OTHER PUBLICATIONS

Inventor: Gary M. Hase et al., U.S. Appl. No. 10/917,316, filed Aug. 13, 2004, "Container With Lid Prop and/or Lid Latch".

* cited by examiner

FIG. 4
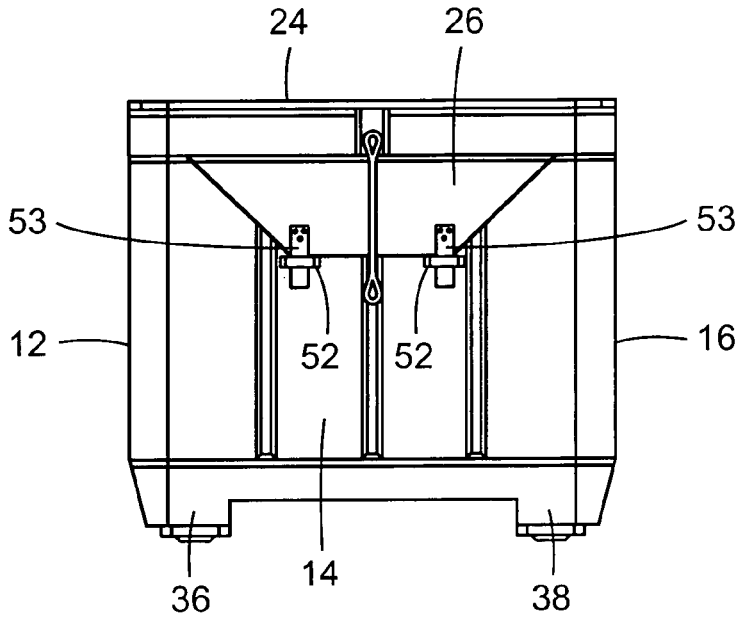
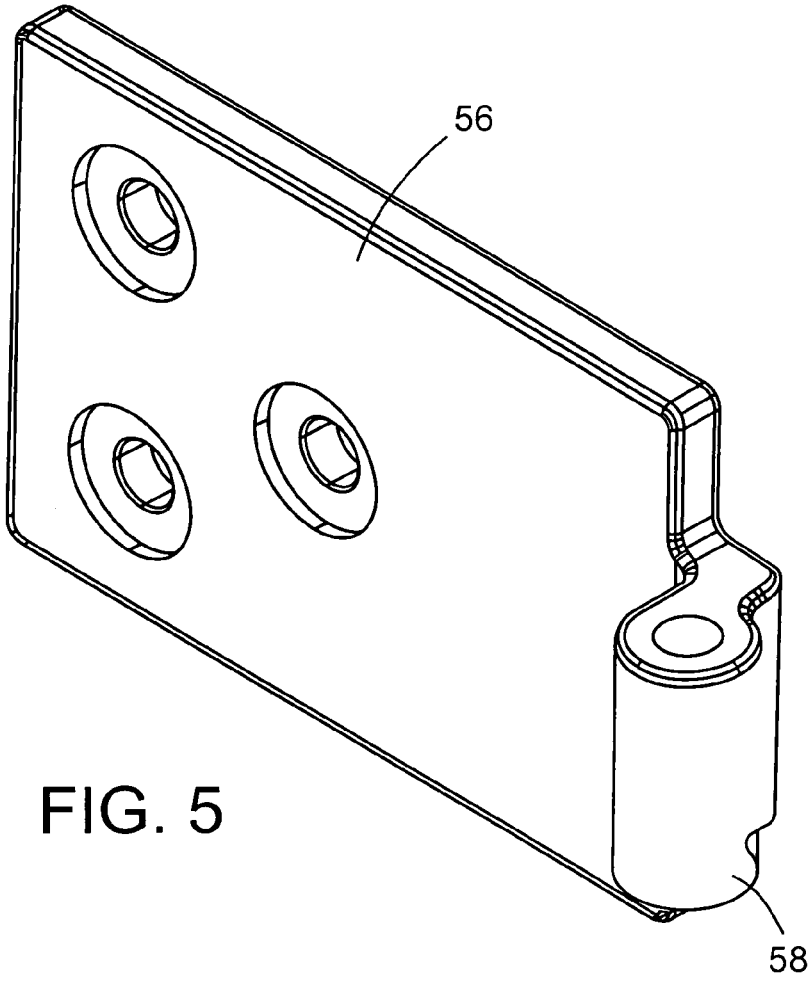
FIG. 5

INSULATED CONTAINER WITH ACCESS DOOR

BACKGROUND OF THE INVENTION

1. Field of the Invention

The present invention relates to an insulated container, and more particularly, to an insulated container providing a convenient access.

2. Discussion of Related Art

It is known in the art to provide insulated containers for shipping goods in a controlled thermal environment. Such a container is frequently a substantially parallelepiped structure made from rotationally molded, insulated walls. In one such structure, each of the dimensions is approximately between three and four feet, thus providing a structure having a cubic volume of between about twenty-seven cubic feet and sixty-four cubic feet. In such a container, the bottom, four legs, and four walls are typically either formed in one piece or permanently connected to form a unitary structure. The lid or top of the container is a separate two-piece configuration and either fits securely on top of the walls, or is hingeably connected to the walls. The door is hingeably connected to the sidewall of the container.

One known use for such a described container is the shipping and/or storage of dry ice (carbon dioxide) or ice cream. When using such a container, particularly a container having a dimension of at least four feet in height, it is not difficult to remove products from the container when the container is full and the products are near the top of the container. However, as the container is emptied, the user must lean over into the container to remove the products from the bottom of the container. Having to lean over to remove products from the bottom of the container is ergonomically inefficient, uncomfortable, and in the case of dry ice, unnecessarily exposes the user to vapors from the evaporating carbon dioxide. Also using such a container, particularly a container having a one piece lid having dimensions of at least four foot square, is awkward to handle and is ergonomically inefficient and unsanitary if the lid is placed on the ground or floor.

Another insulated structure is disclosed in U.S. Pat. No. 5,310,073, and is described as a freezing container for storing and shipping animal carcasses. The disclosed container includes a truncated portion through which an access is provided. The truncated portion enables the access to be provided closer to the floor of the container than an access which extends through the top of the container. However, the truncated portion also reduces the useable volume of the container. For example, anything within the container above the beginning of the truncated portion could spill out of the container when the access door is opened.

OBJECTS AND SUMMARY

Accordingly, it is an object of the present invention to provide an insulated container which includes an access door that maximizes the useable volume of the container while providing convenient access to the bottom of the interior of the container.

It is a further object of the present invention to provide an insulated container that is convenient to use for loading, storage, shipping and unloading.

It is still another object of the present invention to provide a two piece lid assembly that is easy open and close with out the need of removal also providing convenient access into container.

According to one embodiment of the invention, an insulated container includes a bottom and four walls connected to the bottom; a top which fits on the four walls; at least a portion of the top is pivotally mounted so as to be opened to provide access to the insulated container through a first opening; a portion of one of the four walls provides a second opening for a door which is pivotally mounted so as to be opened to provide access to the insulated container through the second opening; wherein the first and second openings are contiguous to provide a combined access area to the container that extends across both the top and the one of the four walls.

According to another embodiment of the invention, an insulated container comprises a bottom, four walls connected to the bottom; and a top which fits on the four walls so as to form a parallelepiped; a closable access opening, a first portion of the access opening extends through the top and a second portion of the access opening, contiguous to the first portion, extends through one of the four walls; and a two part door that closes the access opening, wherein when the two part door is closed, a first part of the door is coplanar with the top and a second part of the door is coplanar with the one wall.

BRIEF DESCRIPTION OF THE FIGURES

FIG. 4 is a front view of the container of FIG. 1 in a closed configuration.

FIG. 5 is a perspective view of a portion of a hinge used in an embodiment of the present invention.

DETAILED DESCRIPTION OF THE PREFERRED EMBODIMENTS

Figure 1:
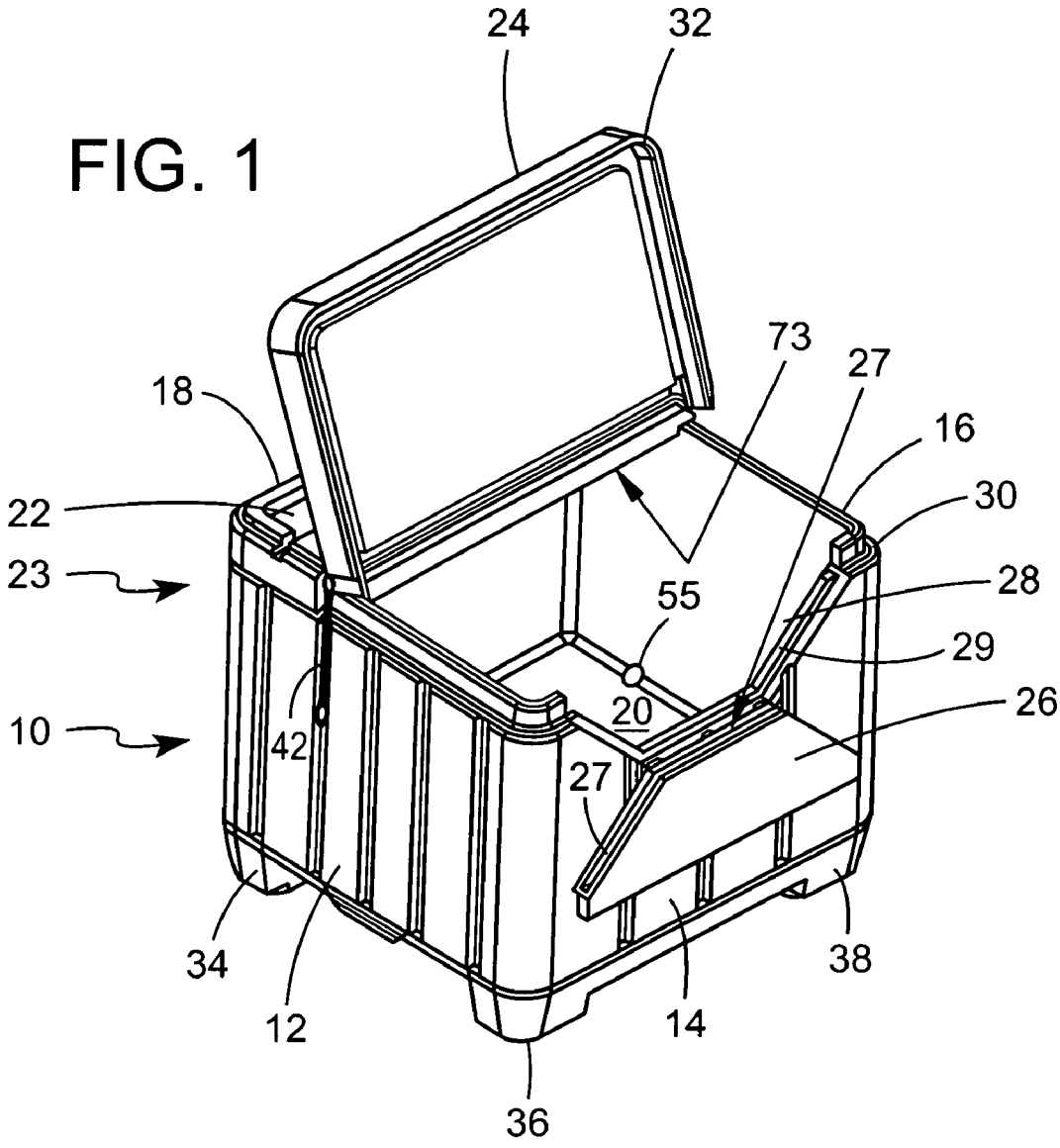
FIG. 1 is a perspective view of a preferred embodiment of the present invention in an open configuration.

FIGS. 1-7 illustrate a preferred exemplary embodiment of an insulated container according to the present invention. In the preferred embodiment, the insulated container is made from rotationally molded plastic, including foamed urethane in the center thereof to enhance the insulation thereof. However, the present invention is not limited to such construction, and the insulated container according to the present invention could be made from any suitable construction known to those of ordinary skill in the art.

The container 10 includes a bottom 20 and four walls 12, 14, 16, 18. The bottom 20 and the four walls 12, 14, 16, 18 are preferably molded as one piece. A top 23 fits on top of the four walls 12, 14, 16, 18. The top 23 preferably includes two parts or portions 22, 24. By arranging the top 23 in two parts 22, 24, it is easier to open the top 23 in that only one of the two parts needs to be raised. This is lighter and less awkward than raising the entire top 23.

One portion of the top 23 includes a plurality of first regions having a first thickness, wherein adjacent first regions are connected to each other by a second region having a thickness less than the first thickness. In one embodiment, the grooves on the top 23 constitute the second regions.

Preferably, the container 10 has four pads 34, 36, 37, 38 secured to the bottom 20, and which can also be molded as one piece with the bottom and four walls. The top 23 includes four recesses 50 which are designed and arranged to accommodate the pads 34, 36, 37, 38 so that a container 10 can be stacked on top of a similar container 10.

Each of the four walls 12, 14, 16, 18 includes a recessed ledge 30. In addition, the top 23 includes a flange 32 extending downwardly therefrom. The walls and top are designed such that the recessed ledge 30 and the flange 32 fit together in a mating configuration to enhance the insulation of the container 10.

Figure 7:
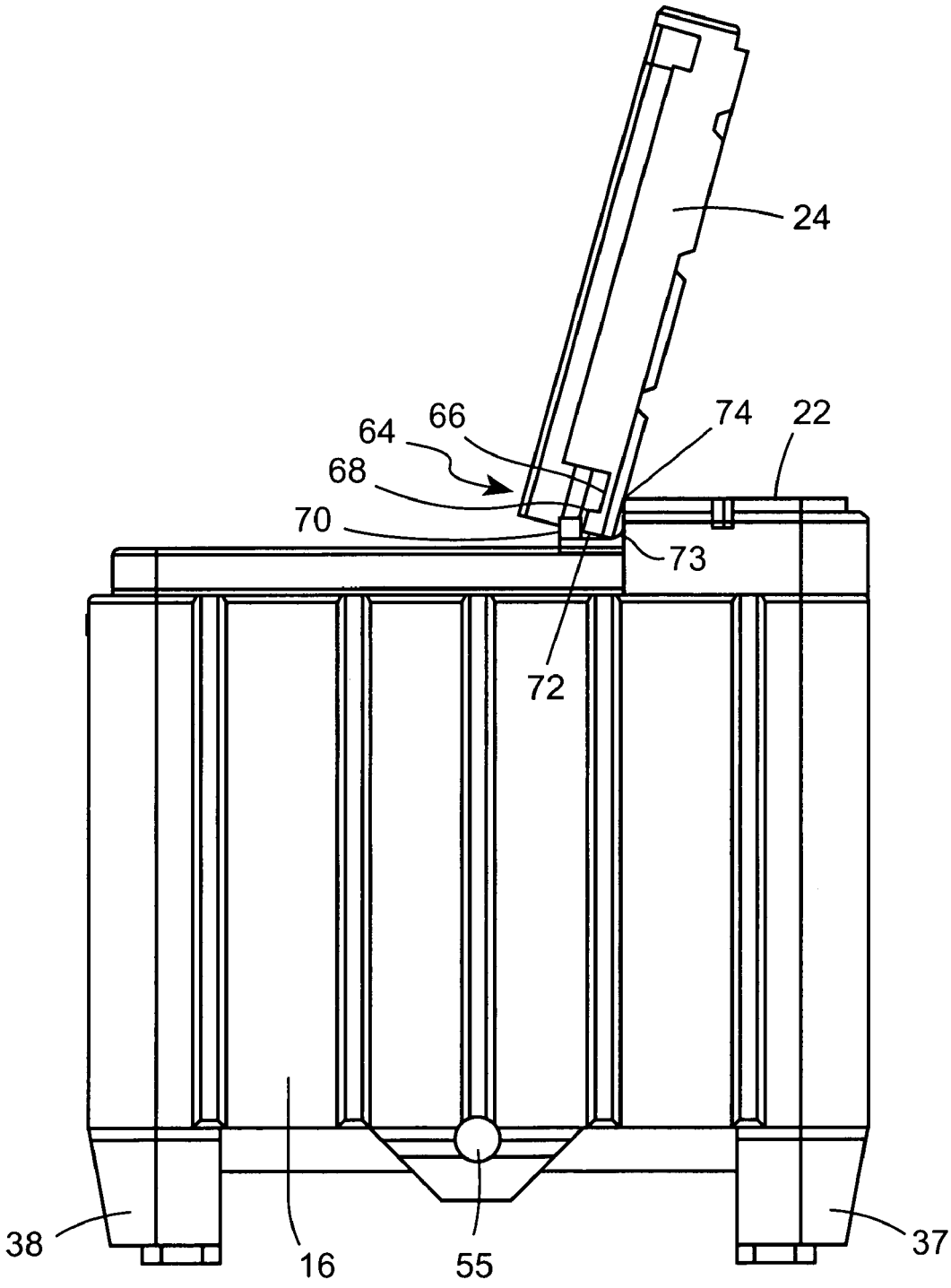
FIG. 7 is a side view of the container of FIG. 1 in an open configuration.

As can be seen from FIGS. 1 and 7, the top includes a first portion 22 and a second portion 24. The first portion 22 includes an edge 73 which incorporates a recess 72 and a ridge 70. The second portion 24 similarly includes an edge 64 which incorporates a recess 66 and a ridge 68. The edge 73 of the first portion 22 engages with the edge 64 on the second portion 24 in such a manner so as to form substantial contact with each other so as to prevent thermal leakage between the two portions. In addition, a surface 74 on the first portion 22 is configured so as to support the second portion 24 in an open configuration when the second portion 24 is opened approximately 110° from the closed position. The overlapping arrangement of the two edges 64, 73 helps provide a seal to minimize water and thermal leakage.

Figure 2:
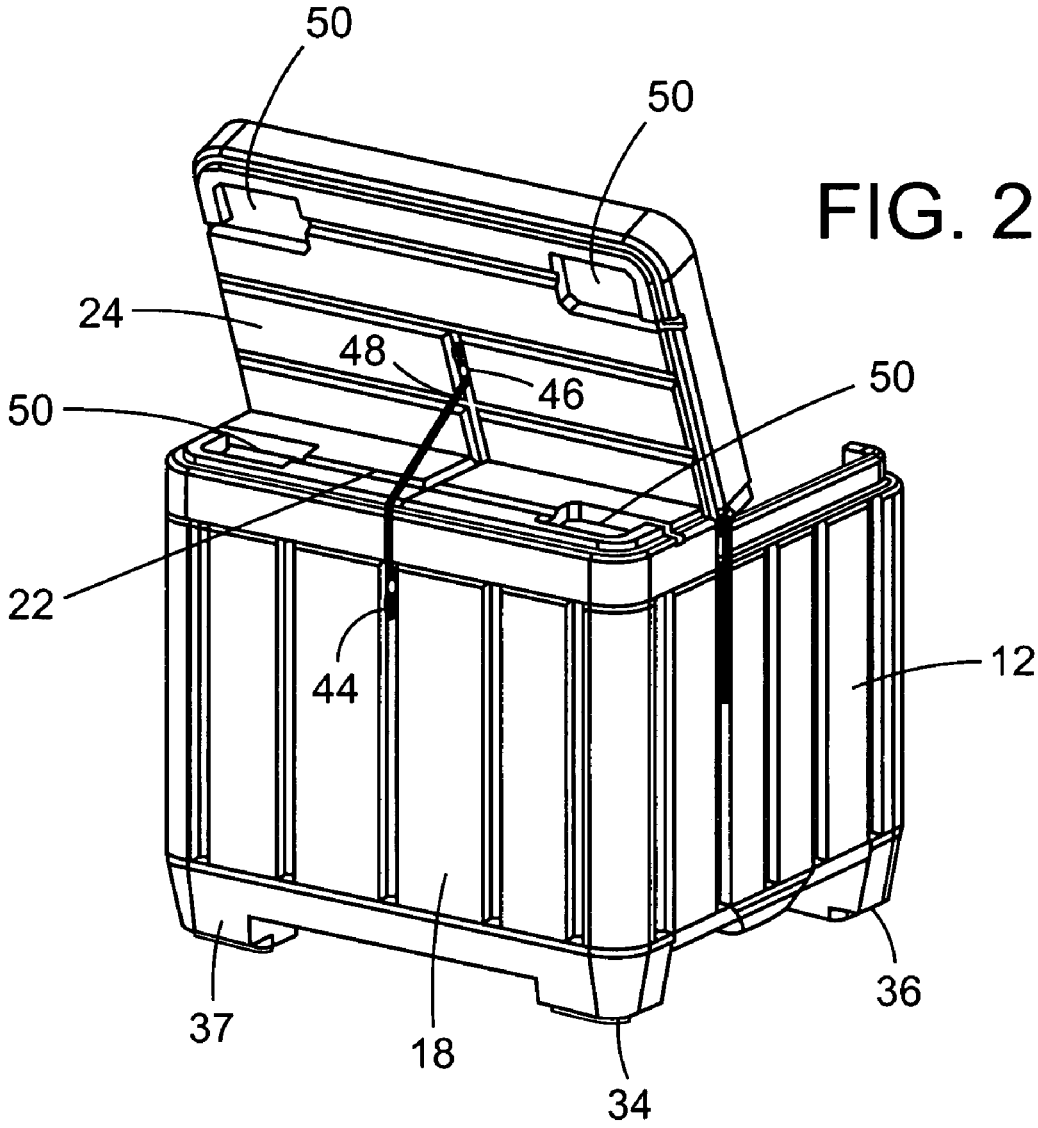
FIG. 2 is a perspective view, from the rear side, of the container of FIG. 1.
Figure 3A:
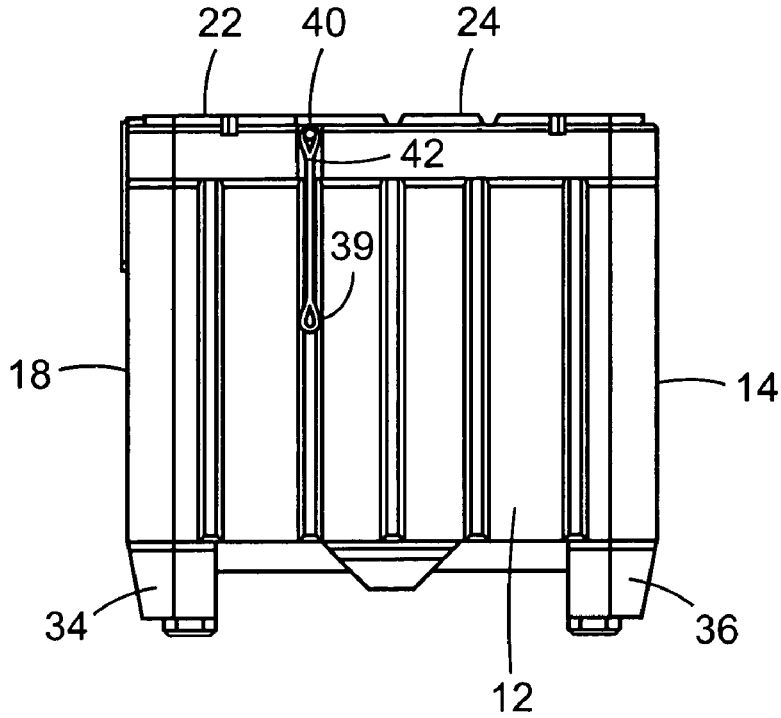
FIG. 3A is a side view of the container of FIG. 1 in a closed configuration.
Figure 3B:
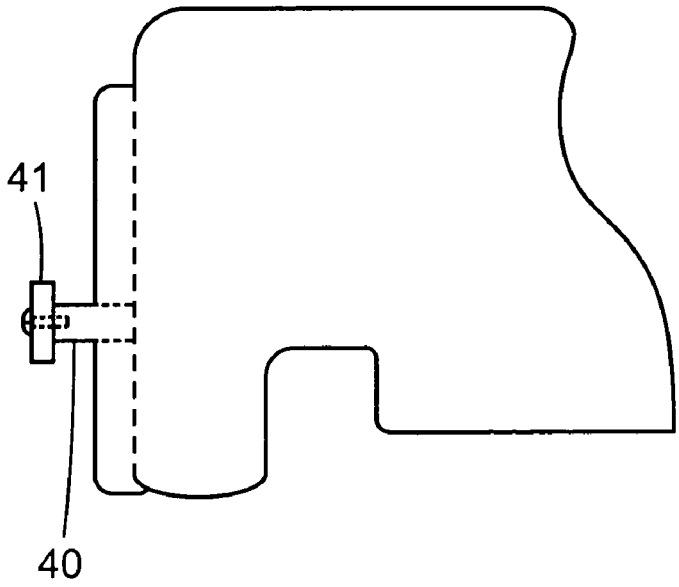
FIG. 3B is an enlarged detail view of a portion of the container of FIG. 1.
Figure 6A:
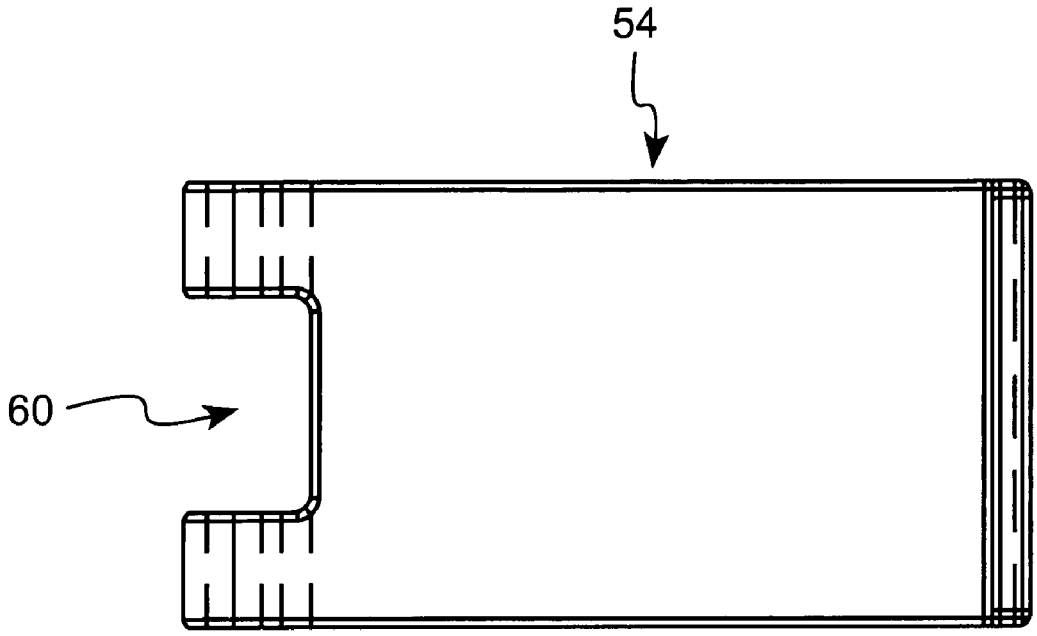
FIG. 6A is a view of a second portion of the hinge used in an embodiment of the present invention.
Figure 6B:
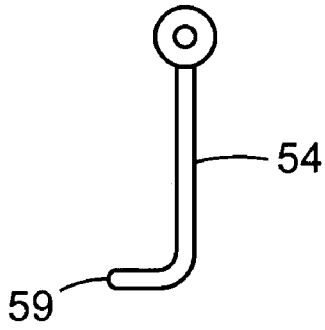
FIG. 6B is a side view of the portion illustrated in FIG. 6A.

As can be seen in FIGS. 1, 2 and 3, the container 10 includes an elastic closing arrangement. Specifically, with regard to top portion 24, a molded stud 40 is provided, as illustrated in FIGS. 3A and 3B. Similarly, a corresponding bracket 39 is provided on the sidewall 12. An elastic cord 42 is interconnected between the bracket 39 and the molded stud 40, and provides a downward, restraining force, on the parts 22 and 24 of the top, while still enabling the top 24 to be opened. The bracket 39 can be of any suitable type. In one embodiment, the molded stud 40 includes a post applied washer assembly 41 that creates a flange on the molded stud that keeps the elastic cord 42 from slipping off. The bracket 39 and stud 40 are also preferably arranged so that the cord 42 is recessed in a groove along the wall of the container. A similar set of studs and brackets can be provided on wall 16.

In addition, brackets 39 mounted on the rear wall 18 and the second part 24 of the top, respectively, hold an elastic cord 48. The elastic cord 48 facilitates raising the top part 24 and holds the second part 24 of the top 23 in an upright position after it is been raised by a user.

The front wall 14 includes a trapezoidal shaped opening 28 which includes a ridge 29 mounted on the edge of the trapezoidal shaped opening 28. In addition, a front door 26 is adapted to close the trapezoidal opening 28. The front door 26 is secured to the front wall 14 with hinges 52 and 53 that are recessed. The hinges 53 include a bottom portion 54 and a top portion 56, which enable the front door 26 to pivot 180°, and also enable the door 26 to lift up about one half an inch when it is in the vertical upright position. The hinges 53 are attached to the front wall 14 by two flat bars 52 that are recessed in the front wall 14 that engage with part 59 of the hinge portion 54 and provide a stop when lifting the door 26, thus allowing the door to pivot 180 degrees. A space 60 on hinge part 54 engages a boss 58 on hinge part 56. Detailed drawings of the hinge 52 can be seen in FIGS. 5, 6A, and 6B.

The door 26 also includes a groove 27 which is designed to accommodate the ridge 29 on the edge of the trapezoidal opening. Accordingly, the door, when closed, can be lifted up and secured so that the groove 27 and the door 26 engages the ridge 29.

When filling the container 10, the door 26 can be lifted up and closed. by opening the second part 24 of the top, the container can be filled with whatever contents are desired. In one embodiment, the container is well suited for storing and shipping dry ice. After the container 10 is filled, the second part 24 can be closed and the container is ready for shipment.

When unloading the contents of the container 10, the second part 24 of the top can be opened, thus providing access to the container. After the contents at the top of the container have been removed, the door 26 can be lifted up and pivoted downwardly so as to provide easier access to the bottom portion of the container 10.

In addition, if desired, a drain 55 may be provided in the bottom 20 and the sidewall 12 of the container 10. The drain is useful for cleaning the container 10, and also useful when shipping contents that might melt, such as regular water ice.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An insulated container, comprising:

a bottom and four walls connected to the bottom;

a cover which fits on the four walls;

a first portion of the cover is pivotally mounted to a second portion of the cover so as to be opened to provide access to the insulated container through a first opening;

a first portion of one of the four walls is pivotally mounted to a second portion of the one of the four walls so as to be opened to provide access to the insulated container through a second opening, wherein the second opening is at a top of the one of the four walls and a width of the second opening is less than a width of the one of the four walls;

wherein the first and second openings are contiguous to provide a combined access area to the container that extends across both the top and the one of the four walls;

wherein each of the four walls and the cover have an inside layer and an outside layer and an insulating material arranged between the inside layer and the outside layer; and wherein an upper edge of each of the four walls includes a recessed ledge, and the cover includes a flange on four sides thereof that engages with the ledges of the four walls.

2. The insulated container according to claim 1, wherein the first portion of the one wall includes a first edge and a second edge, and the first edge is hinged to a remainder of the one wall with a hinge.

3. The insulated container according to claim 2, wherein:

the first portion of the cover includes a first edge and a second edge, and the first edge is pivotally mounted to a remainder of the cover, and the second edge is opposite the first edge;

when the container is closed, the second edge of the first portion of the cover is adjacent the second edge of the first portion of the one wall.

4. The insulated container according to claim 1, wherein the insulated container is a parallelepiped.

5. The insulated container according to claim 1, wherein the first portion of the one wall is a trapezoid with two parallel opposing sides and two nonparallel opposing sides.

6. The insulated container according to claim 1, wherein the container is made from rotationally molded plastic.

7. The insulated container according to claim 1, further comprising brackets mounted on at least two of the walls and one or more elastic cords, engageable with the brackets, for holding the cover in a closed position.

8. The insulated container according to claim 1, further comprising pads on the bottom of the insulated container.

9. The insulated container according to claim 1, further comprising a drain in the bottom of the container.

10. An insulated container, comprising:

a bottom, four walls connected to the bottom; and a cover which fits on an upper edge of at least three of the walls so as to form a parallelepiped, wherein each of the four walls and the cover has an inside layer and an outside layer and an insulating material is arranged between the inside layer and the outside layer;

a closable access opening, a first portion of the access opening extends through a top of the container and a second portion of the access opening, contiguous to the first portion, extends through one of the four walls, wherein a width of the second portion of the access opening is less than a width of the one of the four walls; and a first door component that is coplanar with the top and a second door component that is coplanar with the one wall; and wherein the upper edge of each of the four walls includes a recessed ledge, and the cover includes a flange on at least three sides thereof that engage with the ledges of the at least three walls.

11. The insulated container according to claim 10, wherein the second door component includes a first edge and a second edge, and the first edge is hinged to a remainder of the one wall with a hinge.

12. The insulated container according to claim 11, wherein:

the first door component includes a first edge and a second edge, and the first edge is pivotally mounted to the cover and the second edge is opposite the first edge; and when the container is closed, the second edge of the first door component is adjacent the second edge of the second door component.

13. The insulated container according to claim 10, wherein the second door component is a trapezoid with two parallel opposing sides and two nonparallel opposing sides.

14. The insulated container according to claim 10, wherein the container is made from rotationally molded plastic.

15. The insulated container according to claim 10, further comprising brackets mounted on at least two of the walls and one or more elastic cords, engageable with the brackets, for holding the cover in a closed position.

16. The insulated container according to claim 10, further comprising pads on the bottom of the insulated container.

17. The insulated container according to claim 10, further comprising a drain in the bottom of the container.

18. The insulated container according to claim 1, wherein the first portion of the one wall includes a first edge and a second edge, and the first edge is hinged to a remainder of the one wall with a hinge, wherein at least one portion of the hinge is slidably connected to the remainder of the one wall so that the first portion of the one wall can be lifted vertically prior to pivoting with respect to the remainder of the one wall.

19. The insulated container according to claim 10, wherein the second door component is hinged to a remainder of the one wall with a hinge, wherein at least one portion of the hinge is slidably connected to the remainder of the one wall so that the second door component can be lifted vertically prior to pivoting with respect to the remainder of the one wall.

20. An insulated container, comprising:

a bottom and four walls connected to the bottom;

a cover which fits on at least three of the four walls, wherein each of the bottom, the four walls, and the cover has an inside layer and an outside layer and an insulating material is arranged between the inside layer and the outside layer;

a unitary opening extending through a top of the container and one of the four walls, the unitary opening providing an access to the container that extends through a part of the top of the container and a part of the one of the four walls, wherein a width of the unitary opening where it extends through the part of the one of the four walls is less than a width of the one of the four walls, and the unitary opening extends through less than all of the top;

a first door component and a second door component, wherein the first door component is adapted to close a first portion of the unitary opening while leaving open a second portion of the unitary opening, and the second door component is adapted to close the second portion of the unitary opening while leaving open the first portion of the unitary opening; and wherein an upper edge of each of the four walls includes a recessed ledge, and the cover includes a flange on at least three sides thereof that engage with the ledges of the walls.

21. The insulated container according to claim 20, wherein the first door component includes a plurality of first regions having a first thickness, wherein adjacent first regions are connected to each other by a second region having a thickness less than the first thickness.

22. The insulated container according to claim 20, wherein the container is made from rotationally molded plastic.

23. An insulated container, comprising:

a bottom, four walls connected to the bottom; and a cover which fits on the four walls so as to form a parallelepiped, wherein each of the bottom, the four walls, and the cover has an inside layer and an outside layer and an insulating material is arranged between the inside layer and the outside layer;

a closable access opening extending through one of the four walls at a top edge of the one wall;

the one wall has edges defining the closable access opening;

a door that closes the closable access opening, the door having edges;

wherein one of the edges of the door and the edges defining the closable access opening includes a ridge extending along a length thereof, and the other of the edges of the access door and the edges defining the closable access opening includes a groove extending along a length thereof, wherein the ridge and groove are adapted to engage each other so as to hold the access door in place on the one wall;

wherein the four walls include a recessed ledge at an upper edge thereof and the cover includes a flange that is adapted to engage the recessed ledge;

wherein the container is made from rotationally molded plastic; and further comprising brackets mounted on at least two of the walls and one or more elastic cords, engageable with the brackets, for holding the cover in a closed position.

24. The insulated container according to claim 23, wherein the door is a trapezoid with two parallel opposing edges and two nonparallel opposing edges.

25. The insulated container according to claim 24, wherein the two nonparallel opposing edges and a bottom edge of the access door include the groove extending therealong.

26. An insulated container, comprising:

a bottom, four walls connected to the bottom; and a two piece cover which fits on the four walls so as to form a parallelepiped, wherein each of the bottom and the four walls has an inside layer and an outside layer and an insulating material is arranged between the inside layer and the outside layer;

a closable access opening extends through one of the four walls at a top edge of the one wall;

the one wall has edges defining the closable access opening;

a door that closes the access opening;

wherein one piece of the cover covers the one wall and can be opened leaving a second piece of the cover covering a portion of the top of the container, and when the access door and the one piece of the cover are opened, a contiguous opening at the top of the container is formed in the top of the container and the closable access opening; and wherein the four walls include a recessed ledge at an upper edge thereof and the cover includes a flange that is adapted to engage the recessed edge.

27. The insulated container according to claim 26, wherein one of the door and the edges defining the closable access opening includes a ridge extending along a length thereof, and the other of the door and the edges defining the closable access opening includes a groove extending along a length thereof, wherein the ridge and groove are adapted to engage each other so as to hold the door in place on the one wall.

28. The insulated container according to claim 26, wherein a top edge of the door includes a recessed ledge that engages the flange of the top.

29. The insulated container according to claim 28, wherein the door is a trapezoid with two parallel opposing edges and two nonparallel opposing edges.

30. The insulated container according to claim 29, wherein the two nonparallel opposing edges and a bottom edge of the access door include the groove extending therealong.

31. The insulated container according to claim 26, wherein the container is made from rotationally molded plastic.

32. The insulated container according to claim 26, further comprising brackets mounted on at least two of the walls and one or more elastic cords, engageable with the brackets, for holding the top in a closed position.

* * * * *